US006230985B1

(12) United States Patent
Wang

(10) Patent No.: US 6,230,985 B1
(45) Date of Patent: May 15, 2001

(54) HANDLE STRUCTURE FOR LONG HANDLED SPRINKLER

(75) Inventor: King Yuan Wang, Changhua Hsien (TW)

(73) Assignee: Yuan Mei Corp., Changhua Hsien (TW)

( * ) Notice: Subject to any disclaimer, the term of this patent is extended or adjusted under 35 U.S.C. 154(b) by 0 days.

(21) Appl. No.: 09/541,493

(22) Filed: Apr. 3, 2000

(51) Int. Cl.[7] ..... B05B 15/06
(52) U.S. Cl. ..... 239/273; 239/280; 239/632
(58) Field of Search ..... 239/273, 279, 239/275, 280, 288, 288.3, 288.5, 532, 525; 211/60.1, 74; 248/55, 89; 285/124.3, 124.4; 138/106, 107; 206/443, 589

(56) References Cited

U.S. PATENT DOCUMENTS 3,236,455 * 2/1966 Lewis et al. ..... 239/532
4,057,148 * 11/1977 Meyer et al. ..... 211/74
6,132,684 * 10/2000 Marino ..... 211/74

* cited by examiner

*Primary Examiner*—Lisa Ann Douglas
(74) *Attorney, Agent, or Firm*—Bacon & Thomas, PLLC

(57) ABSTRACT

A handle structure for a long handled sprinkler is made up an elongated tube, a rubber ring retainer and a sprinkling head. At the bottom end of the elongated tube is disposed a control switch and a switch knob is disposed on the outer surface of the control switch with a retaining space formed between the control switch and the switch knob. At the lower portion of the elongated tube is attached a slip-proof grab which is made of flexible rubber. The rubber ring retainer disposed at the top end of the rubber grab is provided with a smoothly tapered surface on which are disposed a plurality of radially extended ribs. The rubber ring retainer has a central hole through which the elongated sprinkler is received whereby the long handled sprinkler can be firmly displayed on a rack having a top layer and a lower layer on that are provided with aligned round holes for allowing a plurality of sprinklers to be retained firmly in place and in neat order for display in an appealing way and allowing people to hold the sprinkles by hand with ease and comfort.

3 Claims, 6 Drawing Sheets

HANDLE STRUCTURE FOR LONG HANDLED SPRINKLER

BACKGROUND OF THE INVENTION

The present invention relates to a handle structure for a long handled sprinkler which is made up of an elongated tube, a rubber ring retainer and a sprinkling head. At the bottom end of the elongated tube is disposed a control switch and a switch knob is disposed on the outer surface of the control switch with a retaining space formed between the control switch and the switch knob. At the lower portion of the elongated tube is attached a slip-proof grab which is made of flexible rubber. The rubber ring retainer disposed at the top end the rubber grab is provided with a smoothly tapered surface of which are disposed a plurality of radially extended ribs. The ring retainer having a central hole is attached to the elongated sprinkler whereby the long handled sprinkler can be firmly displayed on a rack having a top layer and a lower layer on that are disposed aligned round holes for allowing a plurality of sprinklers to be retained firmly in place and in neat order for display in an appealing way and allowing people to hold the sprinklers hand with ease and comfort for a long time.

Referring to FIG. 1, a conventional handle structure for a long hand-held sprinkler 10 has a sprinkling tube 11 at the bottom of which is equipped with a control switch 12. A switch knob 121 is secured to the outer surface of the control switch 12 with a locking space 13 defined between the control switch 12 and the switch knob 121. A long slip-proof rubber grab 14 is provided with a plurality of spaced recesses for easy holding purpose. To the top end of the sprinkling tube 11 is fixed a sprinkler head 15 having multiple type discharging bores. At marketing places, the long handled sprinklers are placed on display racks 20 that are equipped with a top layer 21 and lower layer 22. On the top layer 21 are disposed a plurality of orderly arranged round through holes 211 defined thereon. The lower layer 22 is provided with a plurality of oval shaped retaining cavities 221 that are lined in alignment with the respective round through holes 211 of the top layer 21. Each retaining cavity 221 is provided with a dripping hole 224 at the bottom face thereof and an opening 222 is disposed at one end portion of each oval shaped cavity 221. A positioning plate 223 is disposed next to the opening 222 so that a long handled sprinkler 10 can be retained in place by the through holes 211 and the retaining cavities 223 of the display rack 20.

To firmly hold such a conventional long handled sprinkler 10 by hand, as shown in FIG. 2, the hand of the used grasps the slip-proof rubber grab 14 so as to extend the sprinkler 10 for watering potted plants placed or hanged at a high position.

When long handled sprinklers 10 are to be displayed on a display rack at marketing places, each sprinkler 10 is guided through one round through hole 211 and one aligned oval cavity 221 with the locking space 13 defined between the control switch 12 and the switch knob 121 engaged with the positioning plate 223 and the switch knob 121 housed in the opening 222. In such a manner, multiple long handled sprinklers 10 can be displayed on the display rack 21.

Such a prior long handled sprinkler has the following disadvantages in practical use:

1. It must be held with force when the sprinkler is raised high to water potted plants hanged at a high position.
2. The sprinklers 10 are displayed on the display rack in a chaotic order as a result of the sprinklers 10 being not able to be positioned in a vertical manner.

SUMMARY OF THE INVENTION

Therefore, the primary object of the present invention is to provide an improved handle structure which has a flexible rubber ring retainer. The ring retainer is mounted to the top end of a slip-proof rubber grab with ease so as to permit the sprinkler to be held by the hand of the user in an easy and comfortable manner.

Another object of the present invention is to provide an improved handle structure for a long handled sprinkler which is equipped with a flexible rubber ring retainer which permits the handle to be firmly retained in place and in neat order on a display rack. The display rack are provided a top plate and a bottom plate on each of which has a plurality of round through holes that are in linear alignment with each other so as to permit the elongated handle to be positioned therethrough for display.

DETAILED DESCRIPTION OF THE PREFERRED EMBODIMENTS

Figure 1:
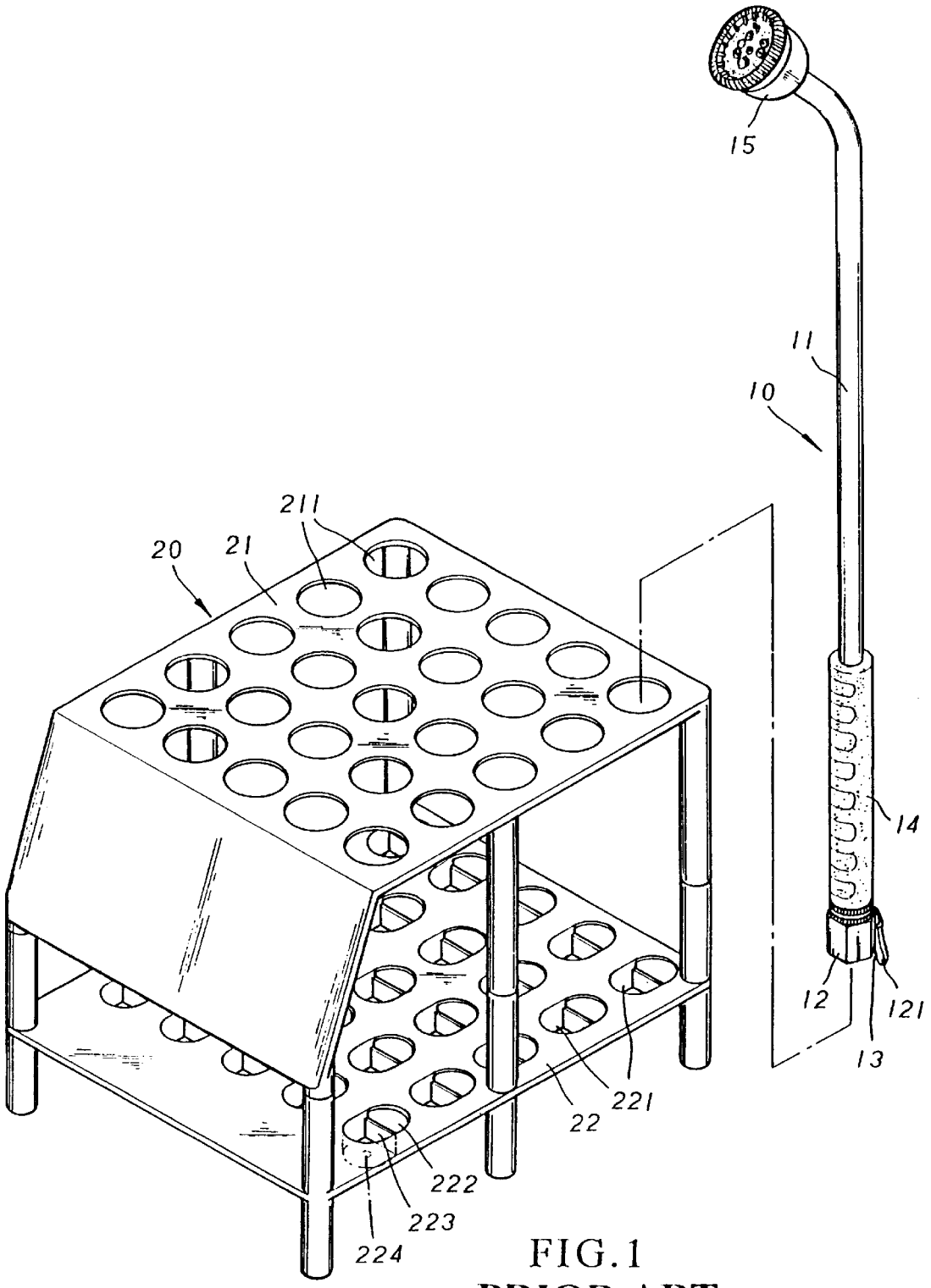
FIG. 1 PRIOR ART
FIG. 1 is an exploded perspective view showing the exploded components of a prior art sprinkler.
Figure 2:
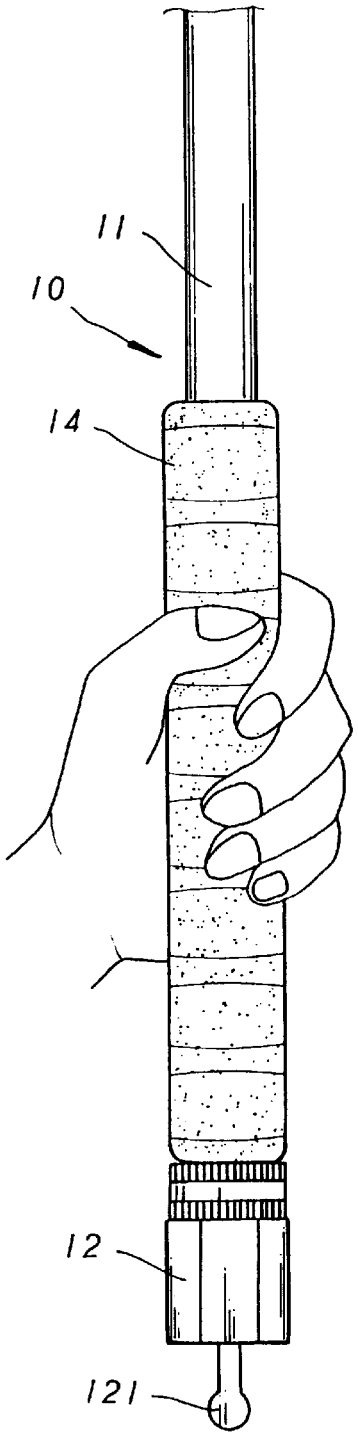
FIG.2 PRIOR ART
FIG. 2 is an elevational view showing a hand holding a conventional sprinkler with a long hand-held handle.
Figure 3:
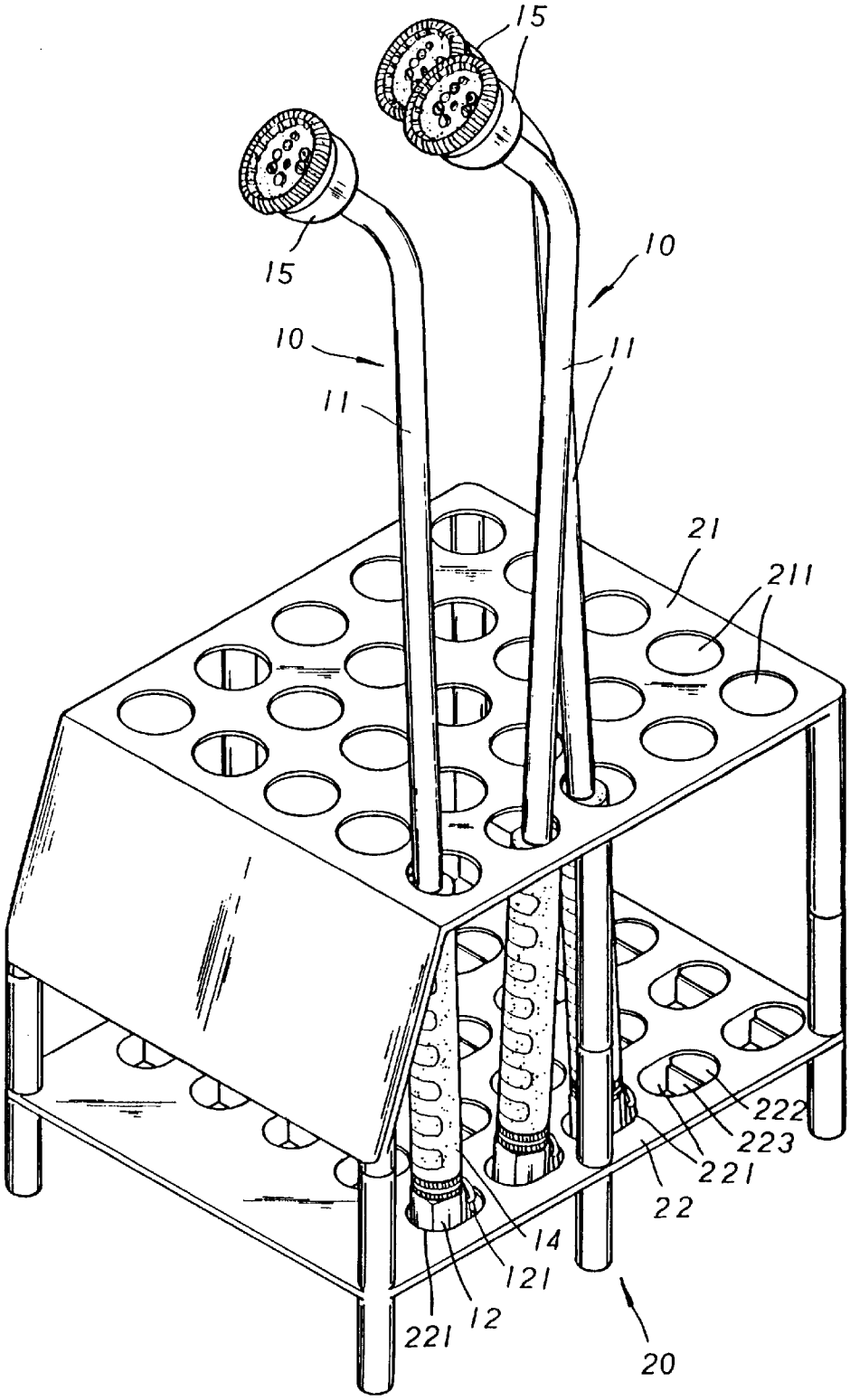
FIG.3 PRIOR ART
FIG. 3 is a perspective view showing conventional sprinklers with a long hand-held handles placed in a display rack.
Figures 4, 4A:
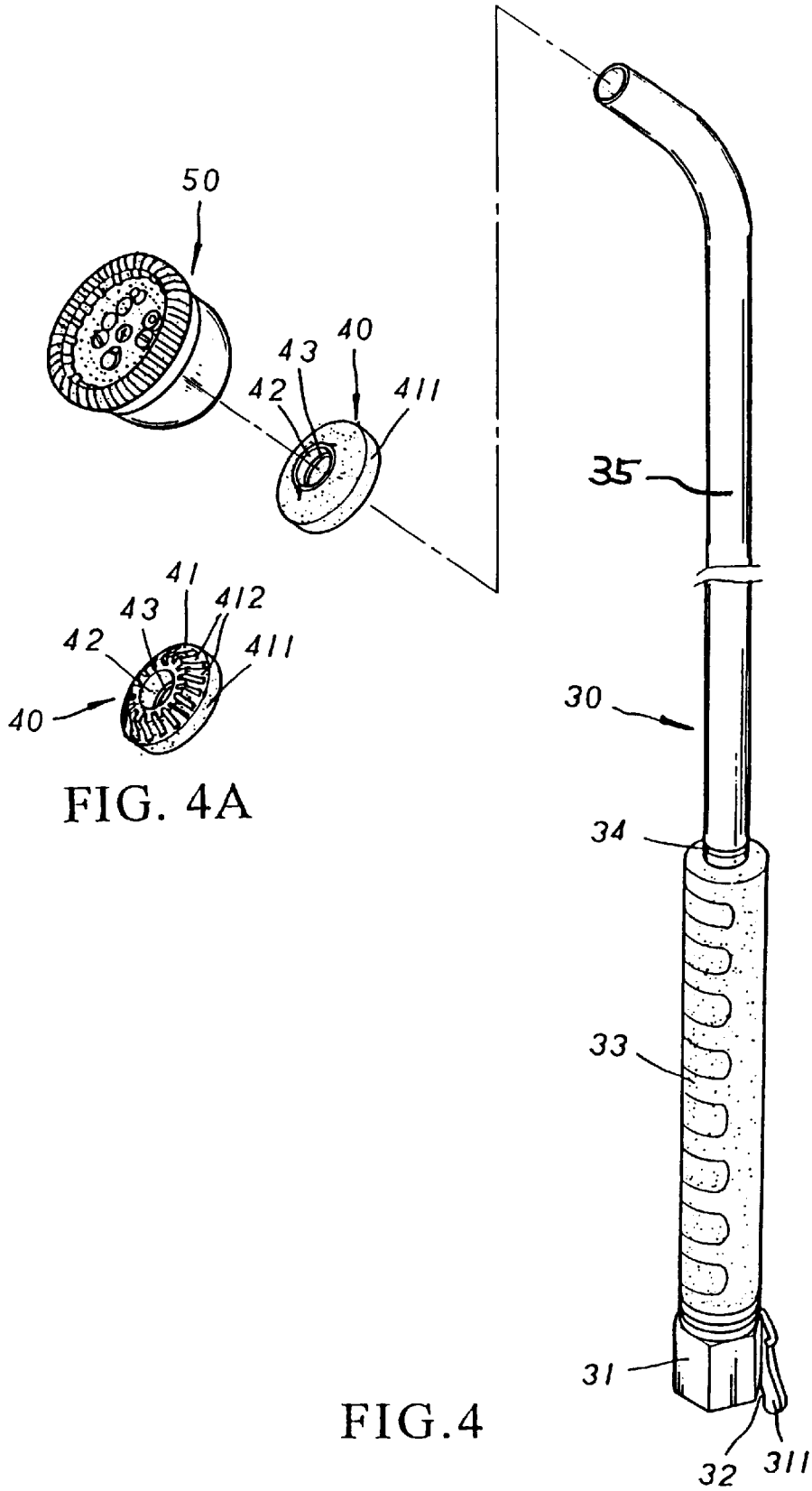
FIG. 4 is an exploded perspective view showing the exploded components of the present invention.
FIG. 4A is a perspective view showing the rubber ring retainer of the present invention.
Figure 5:
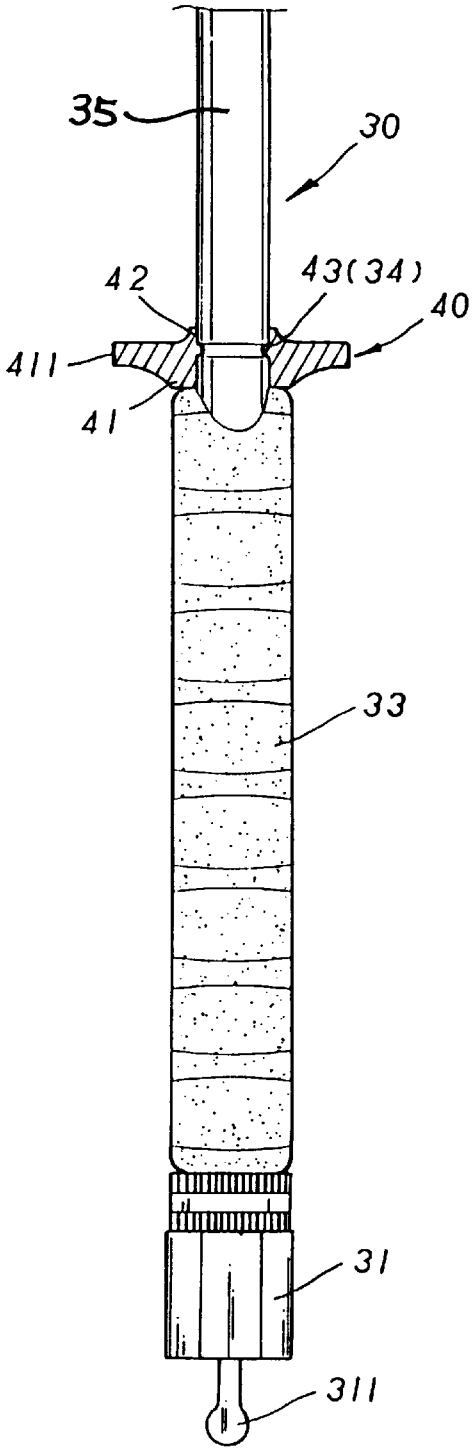
FIG. 5 is an elevational view, partly in section, of the present invention.

Referring to FIG. 4, the long handled sprinkler 30 of the invention is made up of a long sprinkling tube 35, a rubber ring retainer 40 and a sprinkler head 50 having multiple discharging outlets. At the bottom of the long handled sprinkler 30 is disposed a control switch 31 having a switch knob 311 on one external side thereof. A retaining space 32 is formed between the control switch 31 and the switch knob 311. A rubber slip-proof grab 33 secured to a lower portion of the sprinkler 30 is provided with a plurality of spaced grasp recesses thereon. An annular retaining groove 34 of a proper depth is defined on the sprinkling tube 35 adjacent to the top end of the grab 33. A rubber ring retainer 40 is provided with a gradually tapered smooth surface 41 on which are distributed a plurality of evenly spaced recesses 412 with a vertically extended peripheral abutment face 411. A central hole 42 extending through on the ring retainer 40 has a diameter smaller than a diameter of the sprinkling tube 35. On the inner wall of the central hole 42 of the ring retainer 40 is disposed an inwardly extending peripheral rib 43 which permits the ring retainer 40 to be attached to the sprinkling tube 35 right at the top end of the rubber grab 33 and with the peripheral rib 43 engaged within the retaining groove 34, as shown in FIG. 5. At the rear end of the sprinkler head 50 is disposed a water inlet which can be engaged with the top end of the sprinkling tube 35 of the long handled sprinkler 30.

Figure 7:
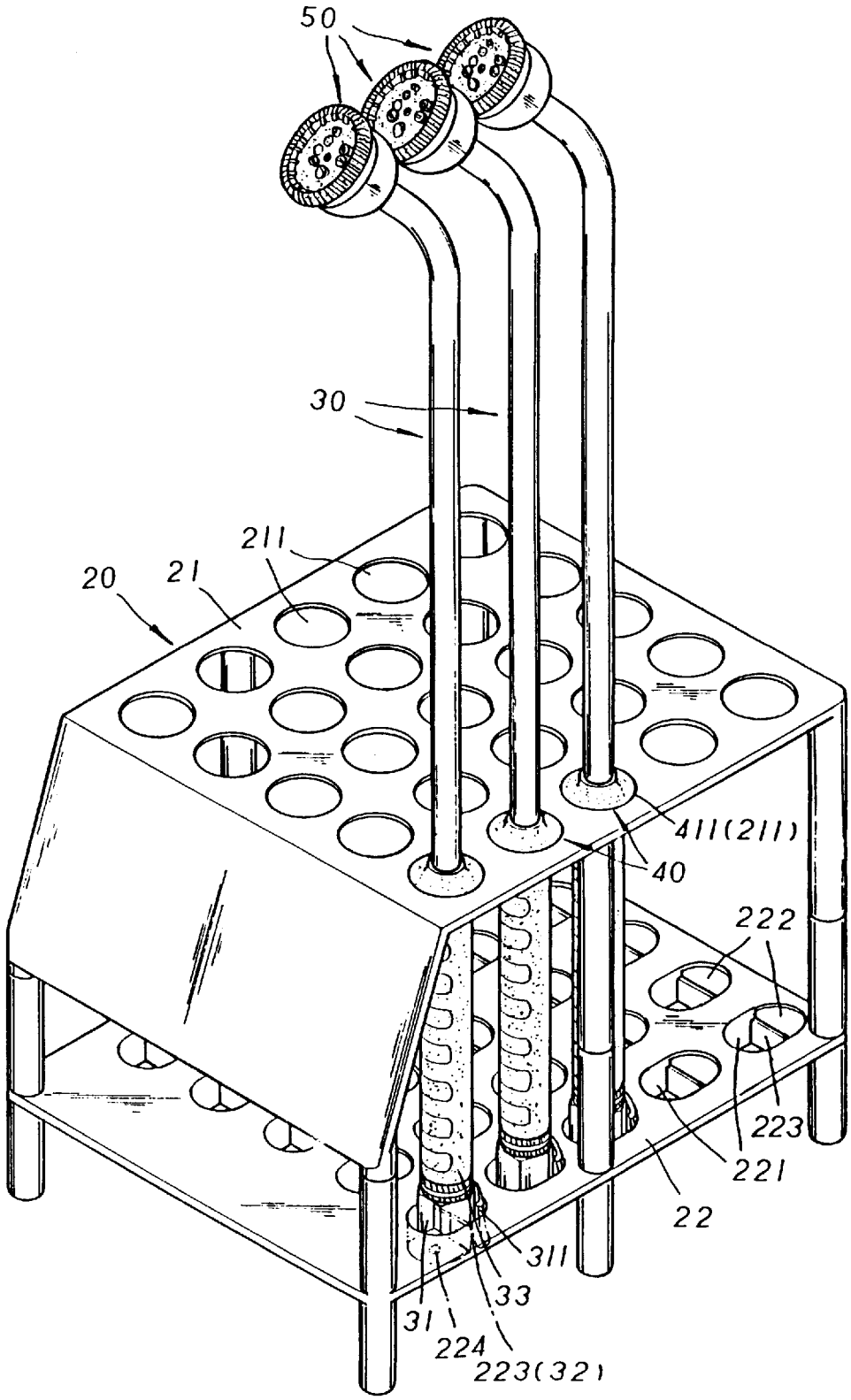
FIG. 7 is a perspective view, partly in section showing sprinklers of the invention placed in a display rack.

Generally, such long handled sprinklers 30 are placed on a display rack 20 at marketing places, as shown in FIG. 7. The display rack 20 has a top layer 21 and a lower layer 22. The top layer 21 is provided with a plurality of evenly spaced round through holes 211. The lower layer 22 has a plurality of oval shaped cavities 221 that are generally placed in alignment with the evenly spaced round through holes 211 of the top layer 21. A through hole 222 is defined at the right portion of each oval cavity 221 and a positioning plate 223 is disposed at the central place of the oval cavity 221. A dripping hole 224 is disposed at the bottom surface of the cavity 221. In arrangement of long handled sprinklers 30 on the display rack 20, the rubber ring retainer 40 of each long handled sprinkler 30 is registered with one round through hole 211 of the top layer 20 and the control switch 31 of the long handled sprinkler 30 is registered with the oval shaped cavity 221 of the lower layer 22. At the same time, the switch knob 311 of each long handled sprinkler 30 is inserted in the through hole 222 of each cavity 221. Thereby, each long handled sprinkler 30 can be vertically retained in place in neat order.

Figure 6:
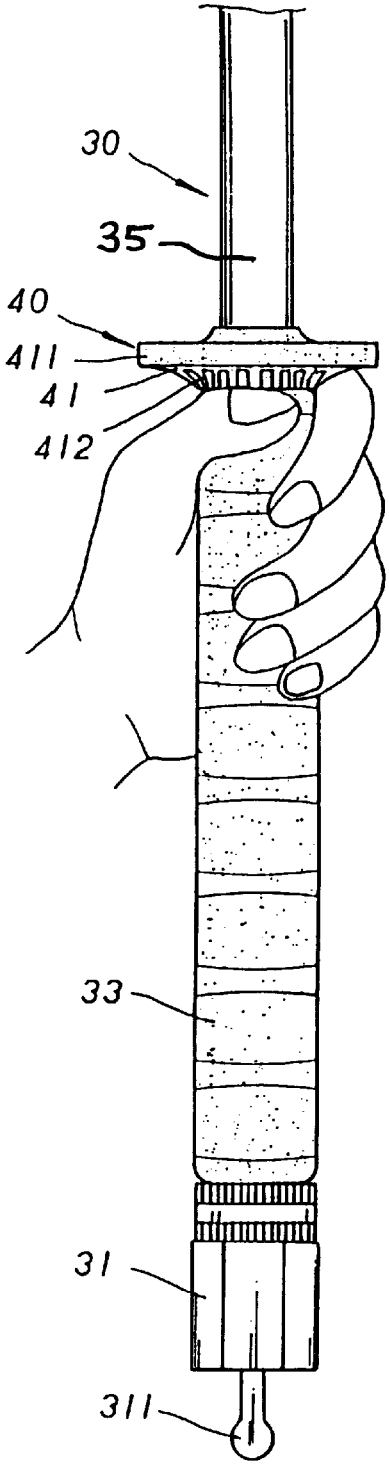
FIG. 6 is an elevational view showing a hand holding the sprinkler with a long hand-held handle of the present invention.

The rubber ring retainer 40 having a central hole 42 is engaged with the sprinkling tube 35 with the peripheral rib 43 thereof registered with the retaining groove 34 at the top end of the rubber grab 33 so that the ring retainer 40 is secured in place with the smoothly tapered surface 41 in abutment against the rubber grab 33 of long handled sprinkler 30. Then the sprinkler head 50 is fixed to the top terminal end of the long handled sprinkler 30 to complete the assembly. As shown in FIG. 6, when the sprinkler 30 is held by hand, the bottom tapered rubber surface 41 of the ring retainer 40 is in contact with the hand of the use so that the long handled sprinkler 30 can be firmly held when the sprinkler 30 is raised high in the air for watering purpose.

In summary, the present invention has the following advantages in practical use:

1. The rubber ring retainer 40 can be easily and quickly attached to the long handled sprinkler 30 so as to permit the long handled sprinkler 30 to be firmly held by hand when raised high in the air for watering purpose.
2. The use of a rubber ring retainer 40 registered with each round through hole 211 of a display rack 20 facilitates each long handled sprinkler 30 to be firmly held in a vertical manner the long handled sprinklers 30 to be arranged on a display rack 20 in a neat and orderly manner.

I claim:

1. A handle structure of a long handled sprinkler comprising a long sprinkling tube, a rubber ring retainer and a sprinkler head having multiple discharging outlets; a bottom end of the long handled sprinkler is provided with a control switch having a switch knob on an external side thereof; a retaining space is formed between said control switch and said switch knob; a rubber slip-proof grab is secured to a lower portion of said sprinkler and provided with a plurality of spaced grasp recesses thereon; said rubber ring retainer is provided with a gradually tapered smooth surface on which are distributed a plurality of evenly spaced recesses and a vertically extended peripheral abutment face; a central hole extending through the ring retainer has a diameter smaller than a diameter of said sprinkling tube; a rear end of said sprinkler head is provided with a water inlet for engagement with the top end of said sprinkling tube of said long handled sprinkler, whereby said long handled sprinkler for displaying on a display rack having a top layer and a lower layer; said top layer having a plurality of evenly spaced rough through holes and said lower layer having a plurality of oval shaped cavities; each cavity has a dripping hole at a bottom face thereof and a through hole defined at a right portion of said oval shaped cavity with a vertical positioning plate disposed at a central position of said oval shaped cavity; each rough through hole is positioned in alignment with each said oval shaped cavity on said lower layer; said control switch of each said long handled sprinkler is located in said oval shaped cavity and said switch knob is registered with said through hole and said vertical positioning plate disposed between said control switch and said switch knob of said long handled sprinkler.

2. The handle structure of a long handled sprinkler as claimed in claim 1 wherein an annular retaining groove is defined on the sprinkling tube adjacent to the top end of said grab; an inner wall of said central hole of said ring retainer is provided with a peripheral rib so as to permit said ring retainer to be firmly attached to said sprinkling tube right at the top end of said rubber grab when said peripheral rib is engaged with said retaining groove.

3. The handle structure of a long handle sprinkler as claimed in claim 1 wherein said rubber ring retainer of said long handled sprinkler for fitting in one of said round through holes on said top layer whereby said long handled sprinkler is vertically retained in said display rack.

* * * * *